United States Patent [19]

Tachibana et al.

[11] 4,231,315

[45] Nov. 4, 1980

[54] WATER-JET PROPULSION UNIT FOR VESSELS

[75] Inventors: Hisataro Tachibana; Hiromi Ono, both of Akashi, Japan

[73] Assignee: Kawasaki Jukogyo Kabushiki Kaisha, Kobe, Japan

[21] Appl. No.: 903,803

[22] Filed: May 8, 1978

[30] Foreign Application Priority Data

May 12, 1977 [JP] Japan ..... 52/54930
May 13, 1977 [JP] Japan ..... 52/55825

[51] Int. Cl.[2] ..... B63H 11/00
[52] U.S. Cl. ..... 440/43; 60/221; 114/121
[58] Field of Search ..... 115/70, 11, 12 R, 12 A, 115/14, 16, 35, 42; 114/151; 60/221, 222

[56] References Cited

U.S. PATENT DOCUMENTS

| | | | |
|---|---|---|---|
| 3,121,994 | 2/1964 | Aldropp | 115/12 R |
| 3,185,124 | 5/1965 | Spence | 115/16 |
| 3,413,950 | 12/1968 | Gravenstreter | 115/12 R |
| 3,426,724 | 2/1969 | Jacobson | 115/12 R |
| 3,982,494 | 9/1976 | Posti | 115/12 R |
| 4,015,556 | 4/1977 | Bordiga | 115/12 R |

*Primary Examiner*—Trygve M. Blix
*Assistant Examiner*—D. W. Keen
*Attorney, Agent, or Firm*—Stevens, Davis, Miller & Mosher

[57] ABSTRACT

Water-jet propulsion unit for vessels which includes a water duct having an inlet and outlet portions and an impeller disposed in the water duct. The outlet portion has a variable outlet nozzle which can discharge water downwardly when desired to produce a lift force for lifting the stern of the vessel. The arrangement provides an improved rolling stability under a stationary condition and is also effective to decrease a drag force under the "hump" condition.

5 Claims, 9 Drawing Figures

WATER-JET PROPULSION UNIT FOR VESSELS

The present invention relates to water-jet propulsion units for vessels. More particularly, the present invention relates to water-jet propulsion units for small-sized vessels.

In general, small-sized vessels or boats for sporting ride must be constructed as compact as possible in order to ensure a satisfactory maneuvarability and for convenience of transportation. Particularly, for ensuring maneuvarability, the width of the vessel should be as small as possible. In such small vessels, the hull of the vessel is subjected to a dynamic pressure applied from the water during cruising so that a lift force is produced to maintain rolling stability of the vessel. However, under a stationary condition, an adequate buoyant force cannot be obtained so that the hull of the vessel is apt to sink excessively. Particularly, the stern portion of the vessel is apt to be sunk below the water surface due to the weight of a person who is on the vessel. In such a condition, the vessel may often be overturned due to lack of restoring force. Thus, it has been difficult in this type of small-sized sporting vessels to have two persons get on the vessel.

Further, in the general water vessels, the hull of the vessel is subjected to a nose-up moment as soon as it has started to go forward and acceleration proceeds so that the bow of the hull is gradually lifted and the stern gradually sunk until a maximum nose-up angle is reached. Under the maximum nose-up angle position which is usually referred to as a "hump condition", the hull of the vessel is subjected to a peak drag force and, when the vessel overcomes the drag force under the "hump" condition, the bow of the hull is gradually lowered and the drag force is correspondingly decreased so that the vessel goes into a normal cruising.

In case of vessels which have a comparatively small bottom area, the stern portion of the hull is excessively sunk under the hump condition so that the hull is apt to force the water forwardly to produce a significantly high drag force. This has an extremely adverse effect on the acceleration performance of the vessel and in some instances the vessel may not be able to overcome the drag force under the hump condition.

It is therefore an object of the present invention to provide a water-jet propulsion unit which can eliminate the aforementioned problems.

Another object of the present invention is to provide a water-jet propulsion unit having means for producing a vertical lift force so as to prevent the stern portion of the vessel from being sunk excessively.

A further object of the present invention is to provide a water-jet propulsion unit which has means for changing the direction of discharge of water jet stream from a horizontal rearward to a vertical downward direction.

The above and other objects can be accomplished, in accordance with the present invention, by a water-jet propulsion unit comprising water duct means having inlet means and outlet means, power-driven impeller means disposed in said duct means for forcing water from the inlet means to the outlet means, means provided in the outlet means of the duct means for changing direction of water flow discharged through the outlet means from a substantially horizontal rearward direction to a substantially downward direction.

According to a simple but preferable aspect of the present invention, the outlet means of the duct means is comprised of rearwardly directed main outlet nozzle means and downwardly directed auxiliary outlet nozzle means, and variable means is provided for restricting water flow through the main outlet nozzle means. The main outlet port means may of course be provided with conventional means for changing the direction of water flow discharged through the main outlet port means in a substantially horizontal plane.

According to another aspect of the present invention, the outlet means of the duct means includes outlet nozzle means of which direction can be changed from horizontal rearward to vertical downward. The nozzle means is comprised of an upper nozzle element movable between a horizontal and vertical positions and having a cross-sectional configuration downwardly opened when it is in the horizontal position. The nozzle means further includes a lower nozzle element which is also movable between horizontal and vertical positions and having a cross-sectional area upwardly opened when it is in the horizontal position so as to define a closed area together with the upper nozzle element. Means is further provided for covering the upper end of the nozzle means when the nozzle elements are in the vertical positions so that the water flow through the nozzle means is directed downwardly. Preferably, the nozzle elements are mounted on an element which is swingable about a vertical axis so that the direction of water flow through the nozzle means can be changed in a horizontal plane.

The above and other objects and features of the present invention will become apparent from the following descriptions of preferred embodiments taking reference to the accompanying drawings, in which.

Figure 3:
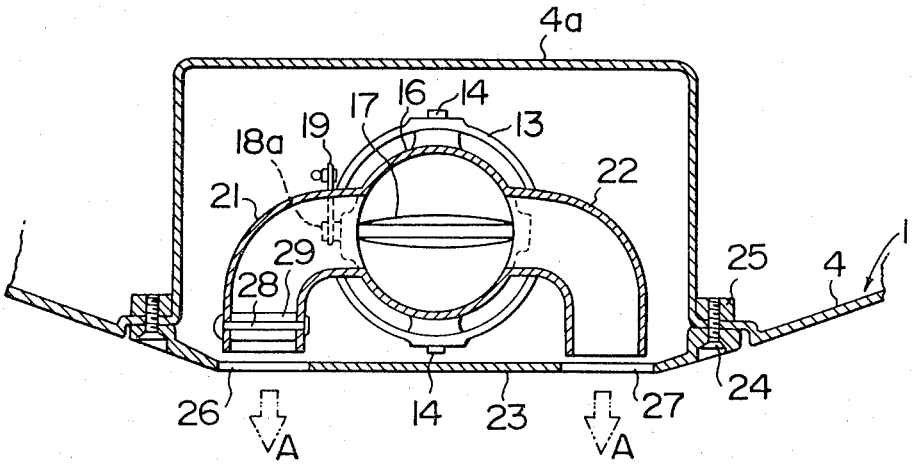
FIG. 3 is a sectional view taken substantially along the line III—III in FIG. 2.
Figure 2:
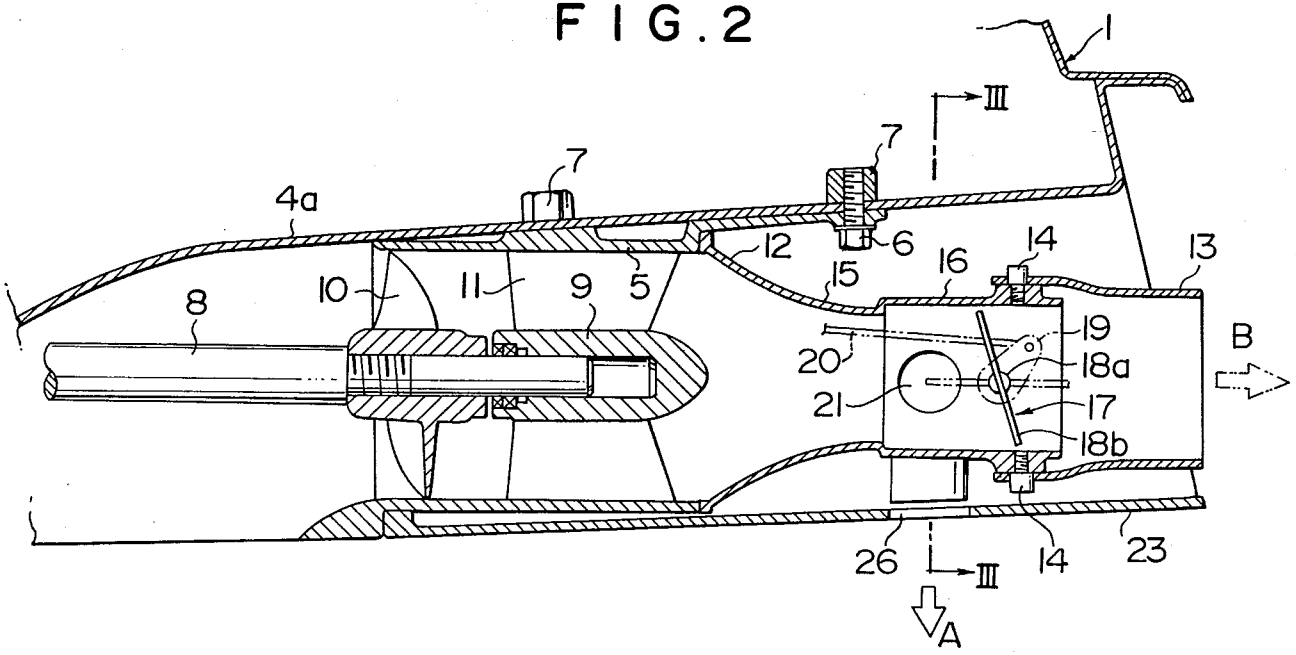
FIG. 2 is a longitudinal section of a water-jet propulsion unit in accordance with one embodiment of the present invention.
Figure 5:
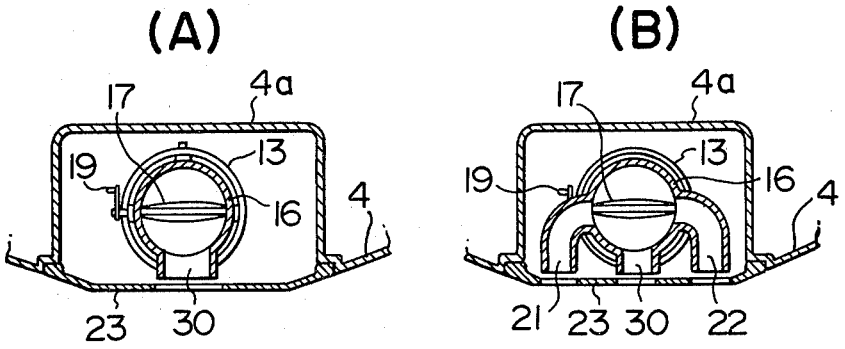
Figure 6:
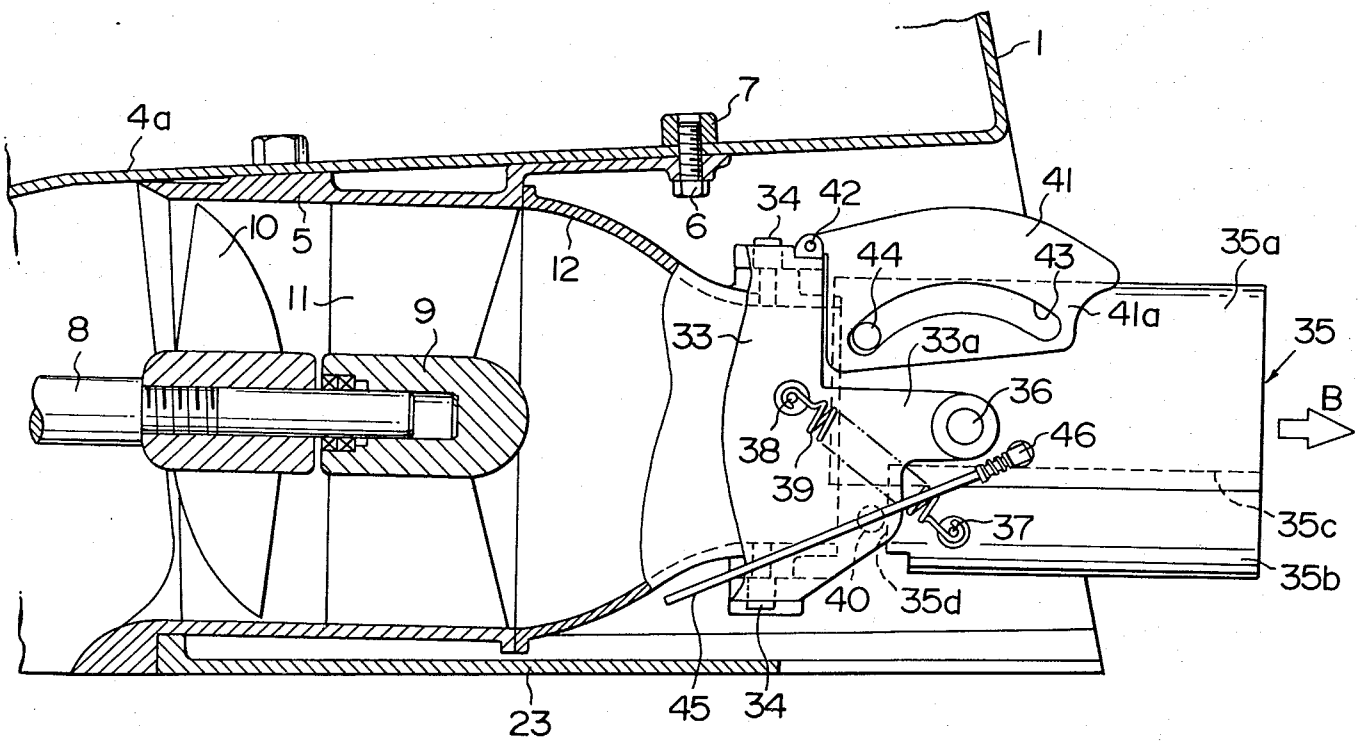
Figure 7:
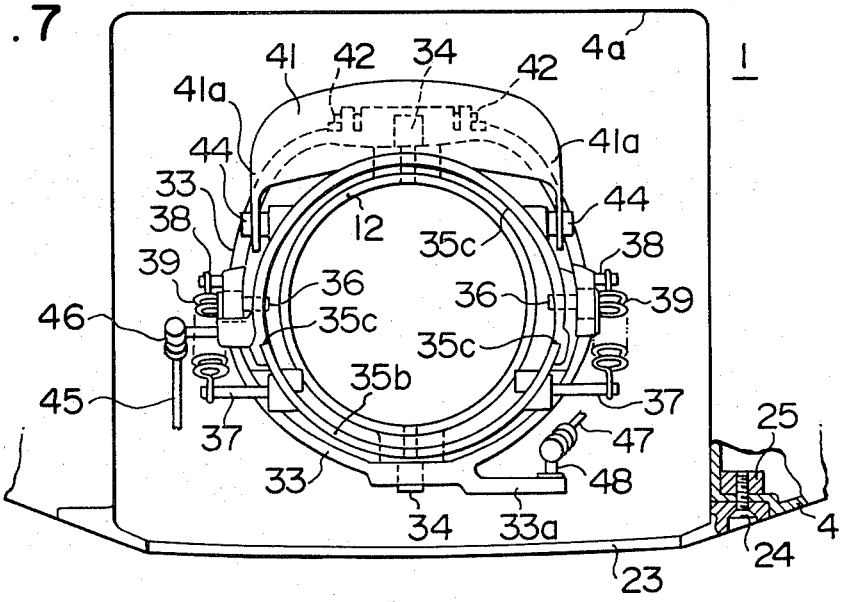
Figure 8:
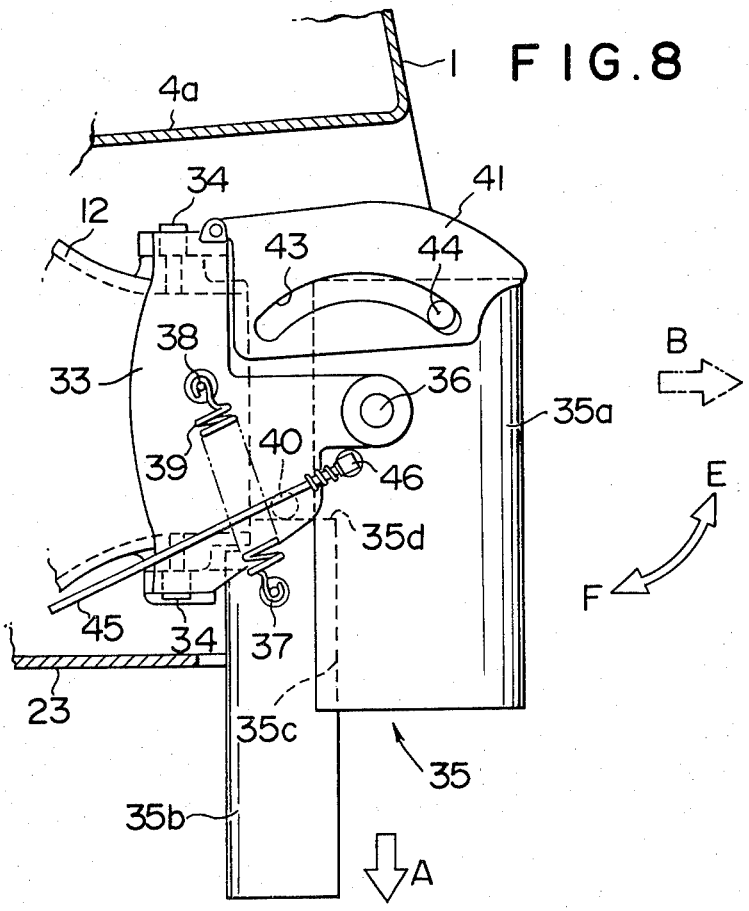

FIGS. 5(A) and (B) show modifications of the embodiment shown in FIGS. 2 and 3;

FIG. 6 is a longitudinal section of a water-jet propulsion unit in accordance with a further embodiment of the present invention;

FIG. 7 is a rear end view of the propulsion unit shown in FIG. 6; and,

FIG. 8 is a side view of the outlet portion of the propulsion unit shown in FIGS. 6 and 7.

Figure 1:
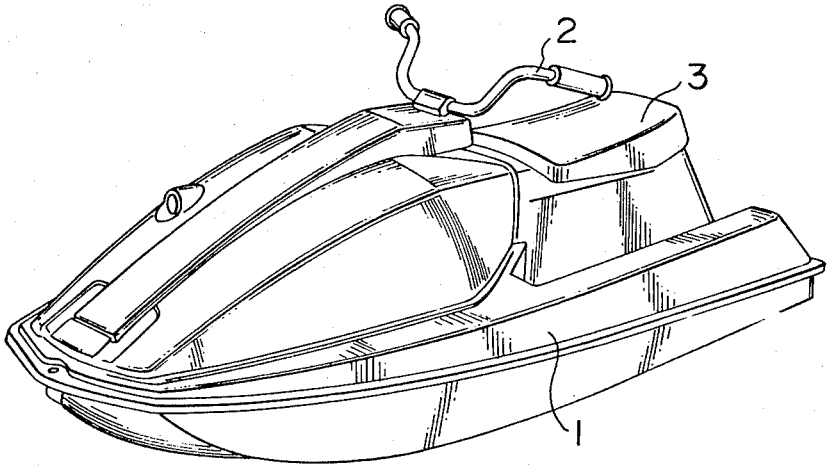
FIG. 1 is a perspective view of a water-jet propelled vessel to which the propulsion unit in accordance with the present invention can well be applied.

Referring now to the drawings, the vessel shown in FIG. 1 includes a hull 1, a handle 2 and a seat 3. As shown in FIGS. 2 and 3, the hull 1 of the vessel has a bottom 4 formed with a longitudinally extending recessed portion 4*a* which is opened at the stern end to provide a water duct. In the recessed portion 4*a*, there is disposed a cylindrical impeller duct 5 which is secured to the bottom 4 of the hull 1 by means of bolts 6 and nuts 7.

The impeller duct 5 carries an impeller shaft bearing 9 through a plurality of stator vanes 11 and an impeller shaft 8 is rotatably supported at the rear end by the bearing 9. The impeller shaft 8 has an impeller 10 which is secured thereto and located in front of the stator vanes 11. Although not shown in the drawings, the impeller shaft 8 is of course carried by a further bearing at the forward portion thereof and driven by means of an appropriate power unit such as an engine.

An outlet nozzle casing 12 is secured to the outlet end of the impeller duct 5 and has a venturi portion 15 and a cylindrical outlet end 16. A steering nozzle 13 is mounted on the outlet nozzle casing 12 at the outlet end 16 by means of a pair of vertically aligned pivot bolts 14 so that the steering nozzle 13 is swingable about the axes of the pivot bolts 14.

The outlet nozzle casing 12 is provided at the cylindrical outlet end 16 with a pair of auxiliary nozzles 21 and 22 which lead from the opposite sides of the outlet end 16 of the casing 12 and are curved downwardly. In the outlet end 16 of the casing 12, there is provided a valve device 17 downstream of the auxiliary nozzles 21 and 22. The valve device 17 includes a butterfly type valve element **18*b* disposed in the casing 12 and carried by a transversely extending valve shaft 18*a*. The valve shaft 18*a* is connected with a lever 19 which is in turn connected with a control cable 20 so that the valve element 18*b*** can be moved between a closed position as shown by solid lines and an open position as shown by broken lines.

A bottom fairing cover 23 is secured to the bottom 4 of the hull 1 by means of bolts 24 and nuts 25. The cover 23 is formed with openings 26 and 27 at positions corresponding to the outlet ends of the auxiliary nozzles 21 and 22. The auxiliary nozzle 21 may if necessary be provided with a drag element 29 carried on a shaft 28 for balancing the lift forces produced at the auxiliary nozzles 21 and 22.

Figure 4:
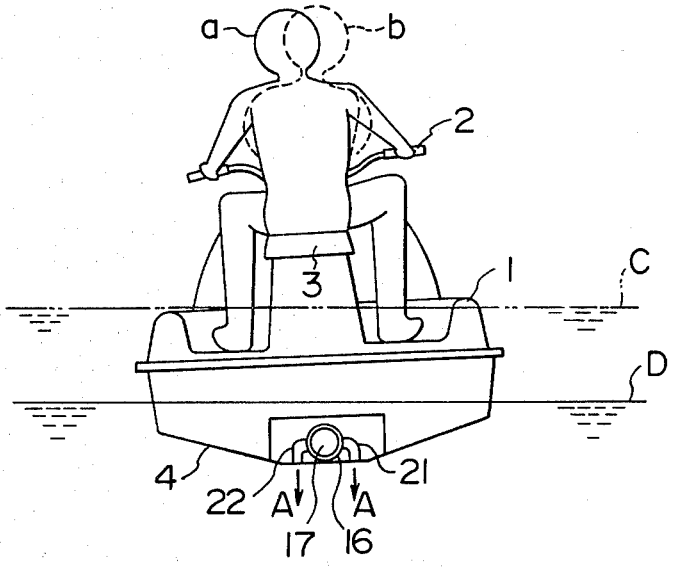
FIG. 4 is a rear end view of the vessel shown in FIG. 1 and equipped with the propulsion unit shown in FIGS. 2 and 3.

In operation, an operator a gets on the vessel and actuates the control cable 20 to move the valve element **18*b* to the closed position so that the outlet end 16 is closed by the valve element 18*b*. When the engine is started and the speed of the impeller 10 is increased, a water stream is forced to flow through the duct casing 5 and the outlet casing 12 into the auxiliary nozzles 21 and 22. Water is thus discharged through the auxiliary nozzles 21 and 22 in the downward direction as shown by arrows A in FIG. 3** to produce a lift force.

Where the water is not discharged downwards, the stern portion of the vessel is sunk due to the weight of the operator a so that the water surface comes up to the level as shown by C in FIG. 4. However, because of the aforementioned downward discharge of water, the lift force is produced as described above and the stern portion of the vessel is lifted so that the level of water surface comes down as shown by D in FIG. 4. In this position of the vessel, an adequate rolling stability can be obtained so that it is possible to have an additional person b get on the vessel.

The operator a may then actuate the control cable 20 to move the valve element **18*b* to a partially open position. Then, a portion of water is discharged rearwardly through the steering nozzle 13 as shown by an arrow B in FIG. 2. Thus, a propulsive force is produced and the vessel is moved forwards. As the speed of the vessel increases, the hull 1 is subjected to a dynamic pressure which applies an increased lift force to the hull 1. The rolling stability is therefore increased so that the valve element 18*b* can further be opened. When the valve element 18*b* is moved to the full open position as shown by the broken lines in FIG. 2, the total amount of water is discharged through the steering nozzle 13. As the vessel is accelerated, the hump condition may be encountered but the drag force under such hump condition can be readily overcome by moving the valve element 18*b* to a partially open position to lead a portion of water through the auxiliary nozzles 21 and 22 to apply a lift force to the stern of the vessel. In decelerating the vessel, the valve element 18*b*** is moved gradually to the close position.

It is preferable that the outlet end 16 of the outlet casing 12 be of a diameter greater than the smallest diameter of the venturi portion 15 as in the illustrated embodiment in order to prevent water from entering the auxiliary nozzles 21 and 22 when the valve element **18*b* is in the open position. The vessel can be steered as desired by pivotably moving the steering nozzle 13 about the axes of the bolts 14** so as to change the direction of discharge of water in a horizontal plane.

Referring now to FIG. 5(A), the modification shown therein is different from the previous embodiment in that the outlet end 16 of the outlet casing is provided with only one auxiliary nozzle 30 which leads from the bottom side of the outlet end 16 and extends downwardly. In the arrangement shown in FIG. 5(B), the outlet end 16 of the outlet casing is provided with three auxiliary nozzles 21, 22 and 30.

Referring now to FIGS. 6 through 8 which show a further embodiment of the present invention, the outlet casing 12 carries at the outlet end a steering member 33 which is mounted thereon by a pair of vertically aligned pivot bolts 34 for swingable movement about the axes of the pivot bolts 14. The steering member 33 has a pair of arms **13*a* extending rearwardly from the opposite sides of the member 33. An upper outlet nozzle element 35*a* having an annular cross-section is mounted on the steering 33 at the rear ends of the arms 33*a* by means of a pair of transversely aligned bolts 36 so that the nozzle element 35*a* is swingable about the axes of the bolts 36**.

Beneath the upper outlet nozzle element **35*a*, there is disposed a lower outlet nozzle element 35*b* which is of an arcuate cross-section and cooperates with the upper nozzle element 35*a* to define a cylindrical outlet nozzle 35. As shown in FIG. 7, the upper element 35*a* has side edges formed with guide recesses 35*c* which receive side edges of the lower element 35*b* for sliding movement. On each side of the nozzle 35, a tension spring 39 is arranged to act between a pin 37 on the lower element 35*b* and a pin 38 on the steering member 18 so as to apply an upwardly and forwardly directed force to the lower outlet nozzle element 35*b*. The steering member 33 has a stop pin 40 on each side for engagement with the forward end 35*d* of the lower element 35*b***.

The steering member 33 further carries a cover 41 which is mounted at its front end on the upper portion of the member 33 by means of a pair of transversely aligned pivot pins 42. The cover 41 has a pair of depending side walls **41*a*. In each side wall 41*a*, the cover 41 has an arcuate slot 43 which receives a pin 44 provided on the upper outlet nozzle element 35*a***.

The upper outlet nozzle element **35*a* is connected through a fitting 46 with a control cable 45 which functions to apply a forwardly and downwardly directed force. The steering member 33 is provided at the lower portion with a sidewardly directed arm 33*a* which is connected through a fitting 48 with a steering control cable 47**.

In this embodiment, the nozzle elements **35*a* and 35*b* are normally maintained at horizontal positions under the actions of the springs 39 as shown in FIG. 6. In this position of the elements 35*a* and 35*b***, a rearwardly directed outlet nozzle is defined so that water is discharged rearwards as shown by an arrow B in FIG. 6.

When a control force is applied through the cable 45 to the upper element 35*a*, the upper element 35*a* is pivoted clockwise about the pins 36 as shown by an arrow E-F. Then the lower element 35*b* is also rotated clockwise with its side edges sliding along the side recesses 35*c* on the upper element 35*a* to assume the position shown in FIG. 8. The pins 44 on the upper element 35*a* are slidably moved along the slots 43 in the cover 41 so that the cover 41 is maintained at a position to cover the upper end of the nozzle element 35*a*. Thus, water stream is discharged in downward direction as shown by an arrow A in FIG. 8.

The invention has thus been shown and described with reference to specific embodiments, however, it should be noted that the invention is in no way limited to the details of the illustrated structures but changes and modifications may be made without departing from the scope of the appended claims.

I claim:

1. A water-jet propulsion unit for a vessel which comprises water duct means having inlet means and an outlet nozzle means variable between a horizontal rearward orientation and a vertical downward orientation, and power-driven impeller means disposed in said duct means for forcing water from the inlet means to said outlet nozzle means, said outlet nozzle means comprising an upper nozzle element means having opposite side edges and a lower nozzle element means also having opposite side edges, said upper and lower nozzle element means being disposed with the side edges on one nozzle element means in slidable engagement with the side edges on the other nozzle element means, said upper nozzle element means and said lower nozzle element means being of cross-sectional configurations to define a closed area between them, one of said nozzle element means being mounted for swingable movement about a horizontal axis, resilient means for biasing the other nozzle element means into slidable engagement with said one nozzle element means at the side edges so that when said one nozzle element means is moved from a horizontal position to a vertical position the other said nozzle element means is slidable moved to a position staggered with respect to said one nozzle element means to provide a vertically directed outlet nozzle means.

2. A water-jet propulsion unit in accordance with claim 1 in which said variable outlet nozzle means is mounted on a nozzle steering means which is swingable about a substantially vertical axis.

3. A water-jet propulsion means in accordance with claim 2, further comprising a cover means provided above said variable outlet nozzle means to close upper portions of said outlet nozzle means when in a vertical position, said cover means having a front end mounted on said nozzle steering means for swinging movement about a horizontal axis and formed with arcuated slot means, said upper nozzle element means having pin means slidably engaging said slot means.

4. A water-jet propulsion unit in accordance with claim 1 further comprising a cover means provided above said variable outlet nozzle means to close upper portions of said outlet nozzle means when in a vertical position.

5. A water-jet propulsion unit in accordance with claim 4 in which said cover means has a front end mounted for swinging movement about a horizontal axis and is formed with arcuated slot means, said upper nozzle element means having pin means slidably engaging said slot means.

* * * * *